United States Patent [19]

Yunoki

[11] Patent Number: 4,598,454

[45] Date of Patent: Jul. 8, 1986

[54] APPARATUS FOR MANUFACTURING SLIDE FASTENERS WITH FLIES

[75] Inventor: Akio Yunoki, Namerikawa, Japan

[73] Assignee: Yoshida Kogyo K. K., Tokyo, Japan

[21] Appl. No.: 658,163

[22] Filed: Oct. 5, 1984

[30] Foreign Application Priority Data

Oct. 7, 1983 [JP] Japan ..... 58-188753

[51] Int. Cl.[4] ..... B23P 19/04; B21D 53/54

[52] U.S. Cl. ..... 29/33.2; 29/408; 29/767; 29/768

[58] Field of Search ..... 29/33.2, 34 A, 769, 29/767, 768, 408, 766

[56] References Cited

U.S. PATENT DOCUMENTS

| | | | |
|---|---|---|---|
| 2,823,388 | 2/1958 | Prupis et al. | 29/33.2 X |
| 2,879,588 | 3/1959 | Morin | 29/408 |
| 2,885,774 | 5/1959 | Waldes | 29/408 |
| 3,530,563 | 9/1970 | Maeda | 29/33.2 |
| 3,844,017 | 10/1974 | Fisher et al. | 29/33.2 |
| 4,333,232 | 6/1982 | Orr | 29/767 |
| 4,443,924 | 4/1984 | Osaki | 29/408 |
| 4,466,168 | 8/1984 | Hatagishi | 29/33.2 X |
| 4,495,686 | 1/1985 | Fisher | 29/33.2 X |

FOREIGN PATENT DOCUMENTS

| | | | |
|---|---|---|---|
| 2105782 | 3/1983 | United Kingdom | 29/766 |

*Primary Examiner*—William R. Briggs

*Attorney, Agent, or Firm*—Hill, Van Santen, Steadman & Simpson

[57] ABSTRACT

An apparatus automatically manufactures a succession of slide fasteners with flies from a continuous slide fastener chain having a pair of intermeshed rows of coupling elements with element-free spaces therein and stringer tapes supporting the rows of coupling elements, respectively, with the flies sewn to one of the tapes. The apparatus includes a feed path along which the chain can be fed along, a fly folder in the feed path for folding one of the flies on itself at a time, a slider applicator in the feed path for mounting one of the sliders at a time on the rows of coupling elements, a feed roller assembly for feeding the chain along the feed path in selective engagement with the intermeshed rows of coupling elements, a bottom stop applicator and chain cutter in the feed path for applying a bottom stop to the rows of coupling elements and cutting off the chain across one of the element-free spaces to produce a slide fastener with a fly, and a discharge roller assembly actuatable in synchronism with the feed roller assembly for discharging the assembled slide fastener with the fly.

12 Claims, 18 Drawing Figures

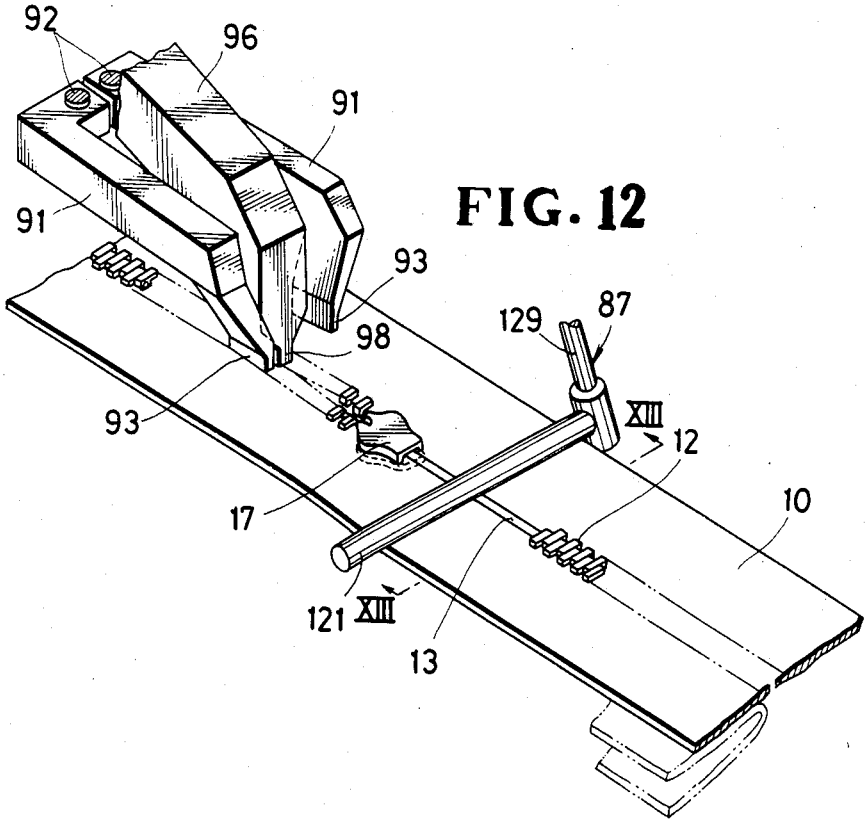
FIG. 12
FIG. 13
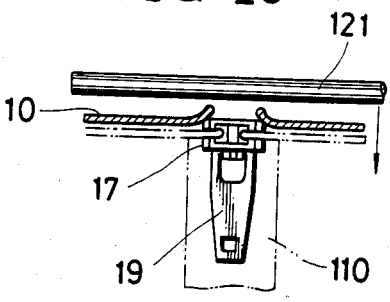

APPARATUS FOR MANUFACTURING SLIDE FASTENERS WITH FLIES

BACKGROUND OF THE INVENTION

1. Field of the Invention

The present invention relates to an apparatus for automatically manufacturing or assembling a succession of slide fasteners with flies sewn thereto.

2. Description of the Prior Art

Various apparatus have been put to use for automatically manufacturing slide fasteners successively. However, no apparatus has been proposed or employed in the art for automatically manufacturing slide fasteners with flies attached thereto.

It has been customary practice to use slide fasteners with flies stitched thereto in advance for increased efficiency when slide fasteners are to be attached to a closing at the front of men's trousers. The fly is sewn to one of the stringer tapes of the slide fastener longitudinally along a transversely substantially central line, the fly being wider than the slide fastener. At the time of sewing the slide fastener, the fly is folded on itself about the stitching and then sewn to the trousers. In the production of slide fasteners with flies, if a fly were to be attached to a finished slide fastener, then difficulty would arise in sewing the fly to the slide fastener on a sewing machine due to the presence of a slider on the slide fastener. Therefore, it is more advantageous to sew flies to a slide fastener chain in advance, and then to process the slide fastener chain into individual finished slide fasteners. However, since flies have already been sewn to the slide fastener chain, the fly has to be folded on itself before a slider is mounted on the chain, and the folded fly presents an increased thickness on one side of the chain, which has prevented the chain from being accurately fed along. The folded fly attached to one of stringer tapes renders the tapes different in rigidity, making it less reliable to thread the tape edges through the slider. For the reasons described above, only manually operated apparatus have been available in the past for manufacturing slide fasteners with flies.

SUMMARY OF THE INVENTION

It is an object of the present invention to provide an apparatus for automatically manufacturing or assembling a succession of slide fasteners with flies from a slide fastener chain with such flies sewn thereto in advance.

According to the present invention, there is provided an apparatus for automatically manufacturing a succession of slide fasteners with flies from a continuous slide fastener chain having a pair of intermeshed rows of coupling elements with element-free spaces therein and stringer tapes supporting the rows of coupling elements, respectively, with the flies sewn to one of the tapes, the apparatus comprising a feed path along which the chain can be fed along, a first means in the feed path for folding one of the flies at a time on itself, a second means in the feed path for mounting one of the sliders at a time on the rows of coupling elements, a feed roller assembly for feeding the chain along the feed path in selective engagement with the intermeshed rows of coupling elements, a third means in the feed path for applying a bottom stop to the rows of coupling elements and for cutting off the chain across one of the element-free spaces to produce a slide fastener with a fly, and a discharge roller assembly actuatable in synchronism with the feed roller assembly for discharging the assembled slide fastener with the fly. The second means comprises a chain splitter for spreading the element-free space and splitting a leading end of the rows of coupling elements, and a slider supply unit angularly movable between a first position in which it receives a slider and a second position for placing the slider in the spread element-free space.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 12 is a perspective view of the slide fastener chain on which a slider is mounted;

FIG. 13 is a cross-sectional view taken along line XIII—XIII of FIG. 12;

DETAILED DESCRIPTION

Figure 1:
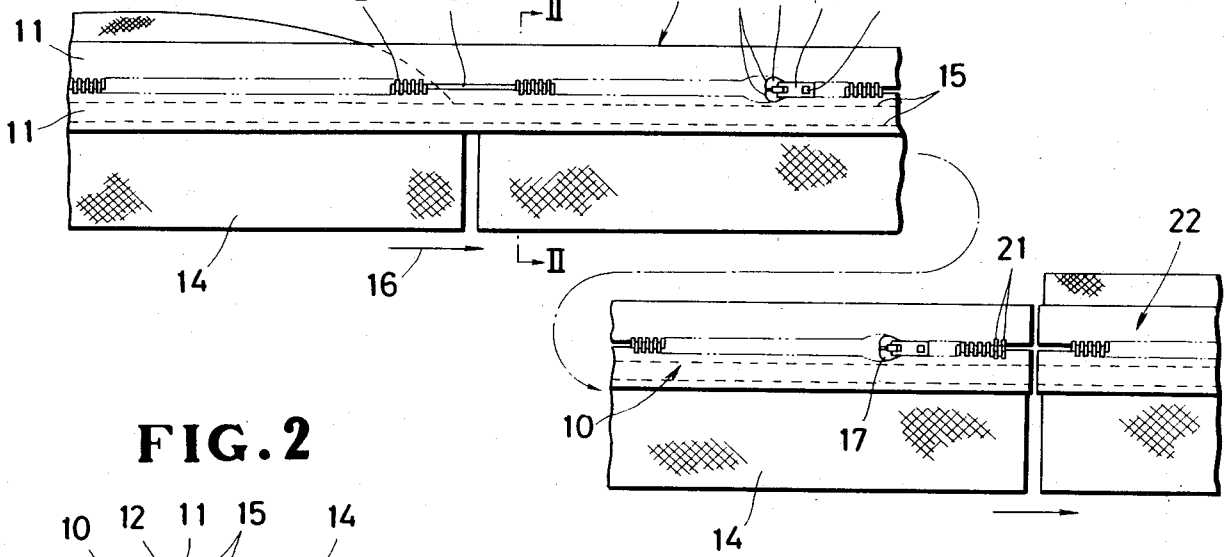
FIG. 1 is a plan view showing the progressive process in which a slide fastener with a fly is manufactured.
Figure 2:
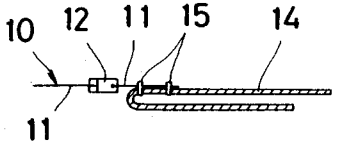
FIG. 2 is a cross-sectional view taken along line II—II of FIG. 1.

As shown in FIGS. 1 and 2, a slide fastener chain 10 is composed of a pair of continuous stringer tapes 11, 11 supporting intermeshed rows of discrete coupling elements 12 on confronting longitudinal edges thereof with an element-free space or gap 13 in the intermeshed rows of coupling elements 12. A fly 14 wider than the chain 10 is sewn to one of the stringer tapes 11 by two rows of sewing threads 15 along a transversely substantially central portion of the fly 14. The chain 10 with the stitched fly 14 is progressively processed as follows:

As the chain 10 travels in the direction of the arrow 16, the fly 14 is folded on itself about the sewing threads 15, as shown in FIG. 2, thus exposing the intermeshed rows of coupling elements 12. A slider 17 is put in the element-free space 13, and the intermeshed rows of coupling elements 12 are threaded through the slider 17 from its open shoulders 18, 18. The slider 17 has a pull tab 19 with a through-hole 20 defined therein. Then, bottom stops 21 are applied to an end of the intermeshed rows of coupling elements 12, and the chain 10 is cut into a predetermined length, thereby completing a slide fastener 22 with the fly 4.

Figure 3:
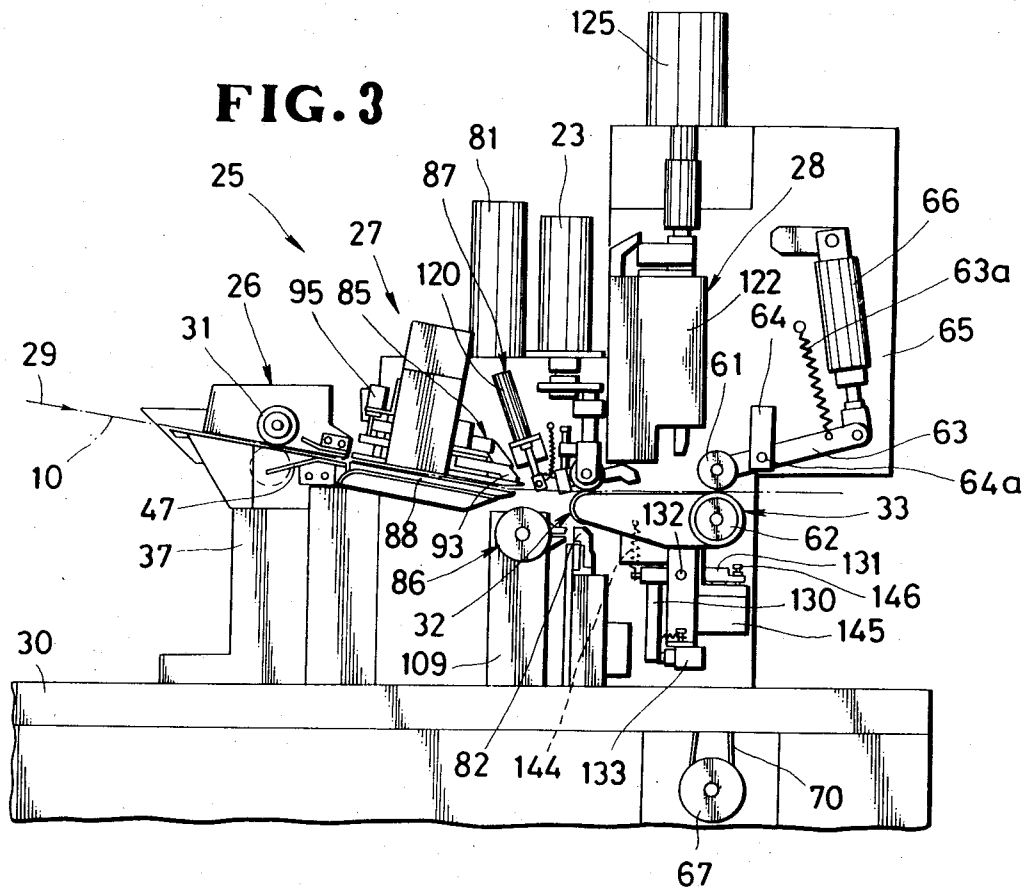
FIG. 3 is a side elevational view of an apparatus for manufacturing slide fasteners with flies.
Figure 4:
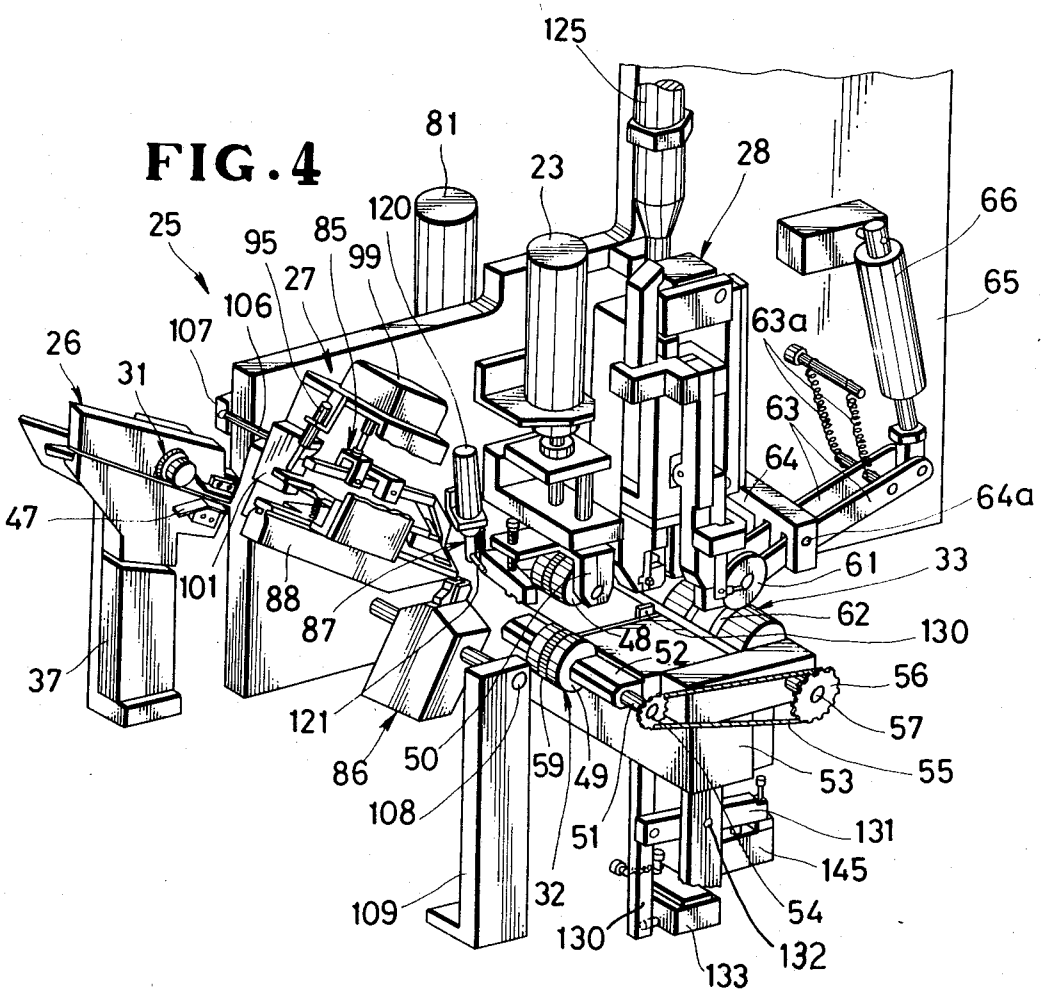
FIG. 4 is a fragmentary perspective view of the apparatus shown in FIG. 3.

The slide fastener chain 10 with the fly 14 can be processed into the slider fastener 22 with the fly 14 by an apparatus generally designated by the reference numeral 25 shown in FIGS. 3 and 4. The apparatus 25 essentially comprises a fly folder 26, a slider applicator 27, and a bottom stop applicator and chain cutter 28, which are arranged in the order named along a feed path 29 for the slide fastener chain 10 and mounted on a bed or base 30.

The feed path 29 is primarily defined by a guide roller assembly 31 in the fly folder 26, a feed roller assembly 32 disposed downstream of the slider applicator 7, and a discharge roller assembly 33 disposed downstream of the bottom stop applicator and chain cutter 28.

Figure 5:
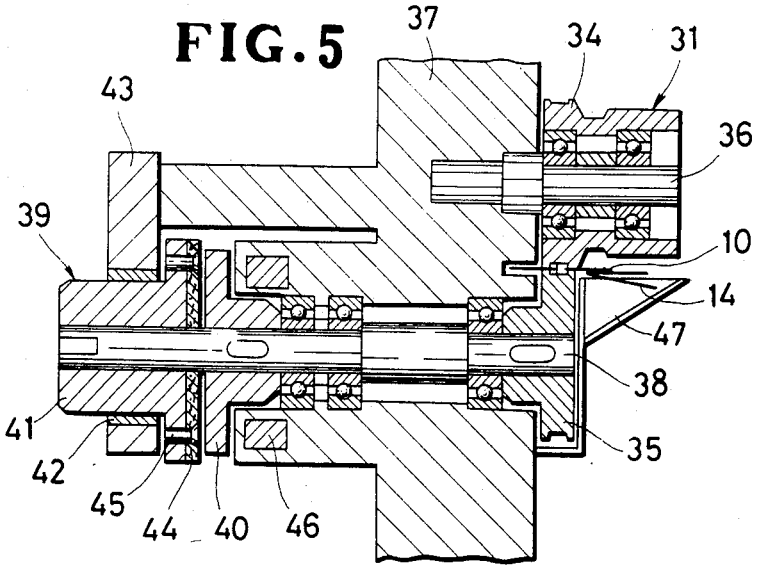
FIG. 5 is a vertical cross-sectional view of a guide roller assembly.

As illustrated in FIG. 5, the guide roller assembly 31 is composed of a pair of upper and lower idling rollers 34, 35 for guiding the intermeshed rows of coupling elements 12 sandwiched therebetween. The upper roller 34 is rotatably mounted by a shaft 36 secured to a vertical support plate 37 mounted on the bed 30. The lower roller 35 is mounted on a shaft 38 extending through the vertical support plate 37 and supporting thereon a brake mechanism 39. The brake mechanism 39 includes a disk 40 keyed to the shaft 38 for rotation therewith, a brake drum 41 with a brake shoe 42 force-fitted thereover and fixedly mounted in an attachment plate 43 mounted on the vertical support plate 37, and a clutch plate 44 axially movably attached to the brake drum 41 by a number of pins 45. An electromagnet 46 is mounted in the vertical support plate 37 closely to the disk 40. In response to energization of the electromagnet 46, the clutch plate 44 can be pressed against the disk 40 to stop rotation of the guide roller assembly 31 for thereby interrupting the travel of the chain 10.

As the chain 10 is fed along through the guide roller assembly 31, the fly 14 starts being progressively folded by an inclined guide plate 47 before reaching the guide roller assembly 31 and is folded completely on itself after moving past the guide roller assembly 31, as illustrated in FIG. 5.

Figure 6:
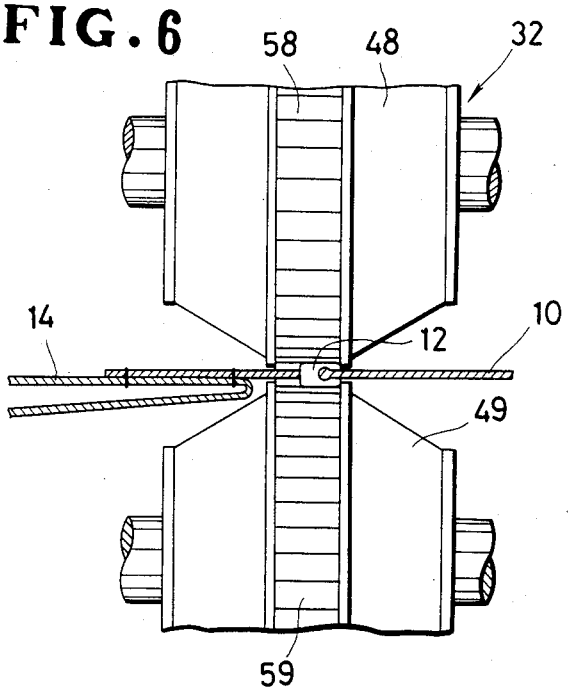
FIG. 6 is a front elevational view of a feed roller assembly.

As shown in FIGS. 4, and 6, the feed roller assembly 32 comprises a pair of upper and lower rollers 48, 49 for feeding the intermeshed rows of coupling elements 12 therebetween. The upper roller 48 is rotatably mounted on a bracket 50 (FIG. 4) which is movable vertically by a first fluid cylinder 23 to bring the upper roller 48 toward and away from the lower roller 49. The lower roller 49 is rotatably mounted by a shaft 51 in a bearing 52 mounted on a block 53. The shaft 51 supports on an end thereof a sprocket 54 which is driven via an endless chain 55 by a sprocket 56 mounted on an end of a shaft 57 of the discharge roller assembly 33. As shown in FIG. 6, the upper and lower rollers 48, 49 have toothed or otherwise roughened peripheral surfaces 58, 59, respectively, for engaging and driving the intermeshed rows of coupling elements 12.

Figure 7:
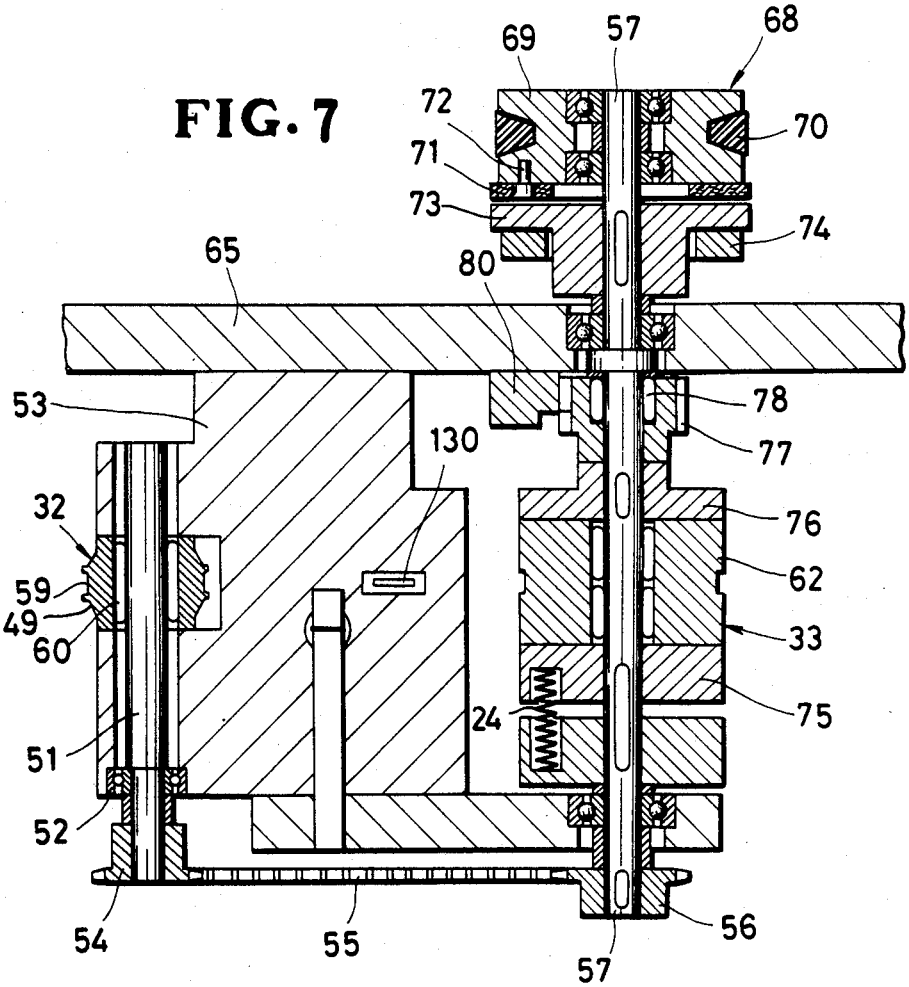
FIG. 7 is a horizontal cross-sectional view of the feed roller assembly and a discharge roller assembly.

As illustrated in FIG. 7, a one-way clutch 60 is disposed between the shaft 51 and the lower roller 49 for rotating the lower roller 49 only in a direction to feed the intermeshed rows of coupling elements 12.

As shown in FIGS. 3 and 4, the discharge roller assembly 33 is composed of a pair of laterally spaced upper rollers 61, 61 and a lower roller 62 coacting with the upper rollers 61, 61 for discharging a completed slide fastener in sandwiching relation. Each of the upper rollers 61, 61 is rotatably mounted on one end of a lever 63 pivotably connected by a pin **64*a* to a bracket 64 mounted on a vertical mount plate 65. The other end of the lever 63 is pivotably connected to a piston rod of a second fluid cylinder 66 supported on the vertical mount plate 65. Thus, the levers 63, 63 are pivotably movable to bring the respective upper rollers 61, 61 into and out of engagement with the lower roller 62, in response to operation of the second fluid cylinder 66. The upper rollers 61, 61 are normally urged against the lower roller 62 by means of a pair of tension coil springs 63*a*, 63*a* acting between the respective levers 63, 63 and the vertical mount plate 65. The levers 63, 63 are loosely connected to the piston rod of the cylinder 66 such that the levers 63, 63 are pivotally movable against the bias of the respective springs 63*a*, 63*a* when the chain 10 is passed between the upper and lower rollers 61, 62. As illustrated in FIG. 7, the lower roller 62 is supported on the shaft 57 which is rotatably supported on the vertical mount plate 65 and which is driven by a motor 67 (FIG. 3) mounted in the bed 30 through a drive mechanism 68. The drive mechanism 68 includes a pulley 69 rotatably mounted on an end of the shaft 57 remote from the sprocket 56 and rotatable by a belt 70 trained around the pulley 69 and a pulley (not shown) coupled to the motor 67. A clutch plate 71 is axially movably mounted by a pin 72 on the pulley 69. A disk 73 supporting an electromagnet 74 is keyed to the shaft 57 in axially confronting relation to the clutch plate 71. The lower roller 62 is axially interposed between a pair of set collars 75, 76 and resiliently pressed therebetween by a pair of springs 24 (one being shown) axially acting on the set collar 75. A pinion 77 is mounted by a one-way clutch 78 on the shaft 57 and is held in mesh with a rack 80 which is vertically movable by a third fluid cylinder 81 (FIGS. 3 and 4**).

As shown in FIGS. 3 and 4, the slider applicator 27 is composed of the feed path 29, a chain splitter 85, a slider supply unit 86, and a tape edge inserter 87.

Figure 10:
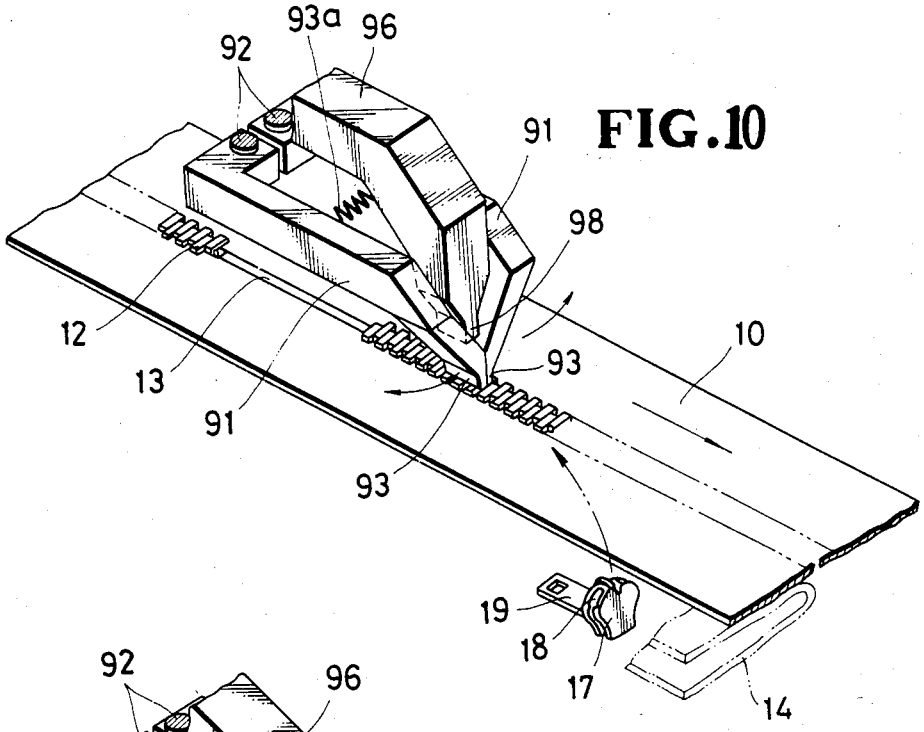
FIG. 10 is a perspective view of a slide fastener chain as it runs below the chain splitter.

The chain splitter 85 is mounted on the vertical mount plate 65 and inclined along the feed path 29 progressively downwardly in the direction in which the chain 10 is fed along. As illustrated in detail in FIGS. 8. and 9, the chain splitter 85 includes a chain guide 88 through which the feed path 29 extends, and an arm 89 vertically angularly movably mounted by a pivot pin 90 on the mount plate 65 above the chain guide 88. A pair of levers 91, 91 (FIG. 10) is laterally swingably mounted by a pair of pivot pins 92, 92 on a forward end of the arm 89. The levers 91, 91 have a pair of downwardly extending fingers 93, 93 for normally contacting an upper surface of the intermeshed rows of coupling elements 12 under the resilient force of a spring 94 acting between the arm 89 and the chain guide 88. Therefore, when any one of the element-free spaces 13 between adjacent lengths of coupling elements 12 reaches the fingers 93, 93, the fingers 93, 93 are displaced downwardly into the element-free space 13 under the force of the spring 94. The fingers 93, 93 will then be lifted out of the space 13 by a fourth cylinder 95 which depresses a rear end of the arm 89 against the resiliency of the spring 94. The fingers 93, 93 are normally urged toward each other by a tension spring 93*a* connected at opposite ends to the respective levers 91, 91, as shown in FIG. 10. Another lever 96 is vertically pivotably mounted by a pivot pin 97 on a bracket 65*a* secured to the mount plate 65, the lever 96 being positioned above the arm 89. The lever 96 has a front wedge 98 directed downwardly between the fingers 93, 93. The lever 96 is operatively coupled by a pin 100 to a bracket 65*b* fixed to a piston rod of a fifth fluid cylinder 99, which will be actuated to move the wedge 98 into a lower position between the fingers 93, 93 or into an upper position above the fingers 93, 93.

Figure 9:
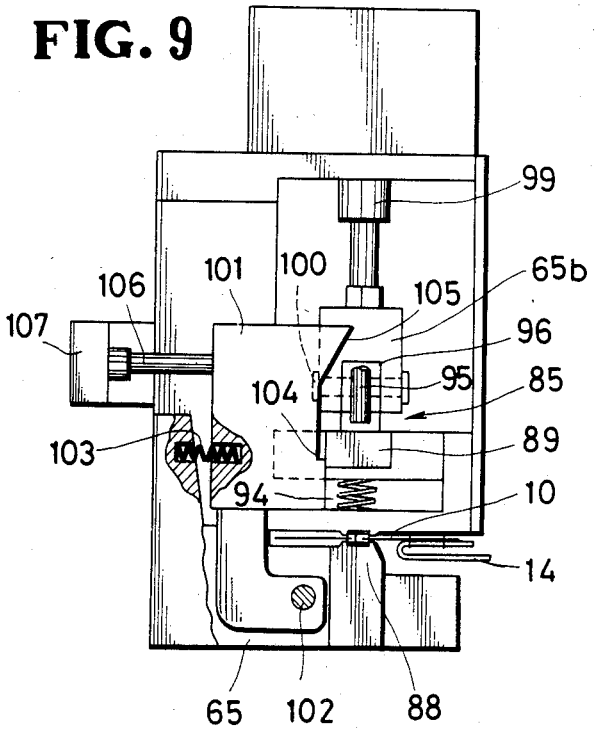
FIG. 9 is a front elevational view of the chain splitter, taken along line IX—IX of FIG. 8.

When the fingers 93, 93 arrive at one of the element-free spaces 13, the fingers 93, 93 project downwardly into the space 13. At this time, the chain 10 is stopped in its travel in response to such downward movement of the fingers 93, 93, as detected by an arrangement shown in FIG. 9. More specifically, a detector plate 101 is positioned laterally of the rear end of the arm 89 for substantially horizontal movement about a pin 102, the detector plate 101 being normally urged by a spring 103 to move toward the arm 89. The detector plate 101 has a shoulder or step 104 facing upwardly and disposed adjacent to the arm 89 and an inclined cam surface 105 progressively projecting laterally in an overhanging relation to the lever 96. A detector rod 106 extends from the detector plate 101 away from the cam surface 105 and has an end normally engaging a sensor 107. When the fingers 93, 93 are moved downwardly into the space 13, the rear end of the arm 89 is raised until it clears the shoulder 104, whereupon the detector plate 101 is turned to the right (FIG. 9). The detector rod 106 now disengages from the sensor 107, which produces an electric signal indicative of the depression of the fingers 93, 93 into the space 13. Thereafter, the wedge 98 is lowered to spread the fingers 93, 93 against the bias of the tension spring 93*a* (FIG. 11) for thereby splitting the intermeshed rows of coupling elements 12 into disengaged rows at the trailing end of the space 13.

When the movement of the chain 10 is interrupted, the brake mechanism 39 for the guide roller assembly 31 is actuated to lock the chain 10 which is now kept taut between the guide roller assembly 31 and the discharge roller assembly 33 so that a slider can smoothly be placed onto the rows of coupling elements 12.

Figure 8:
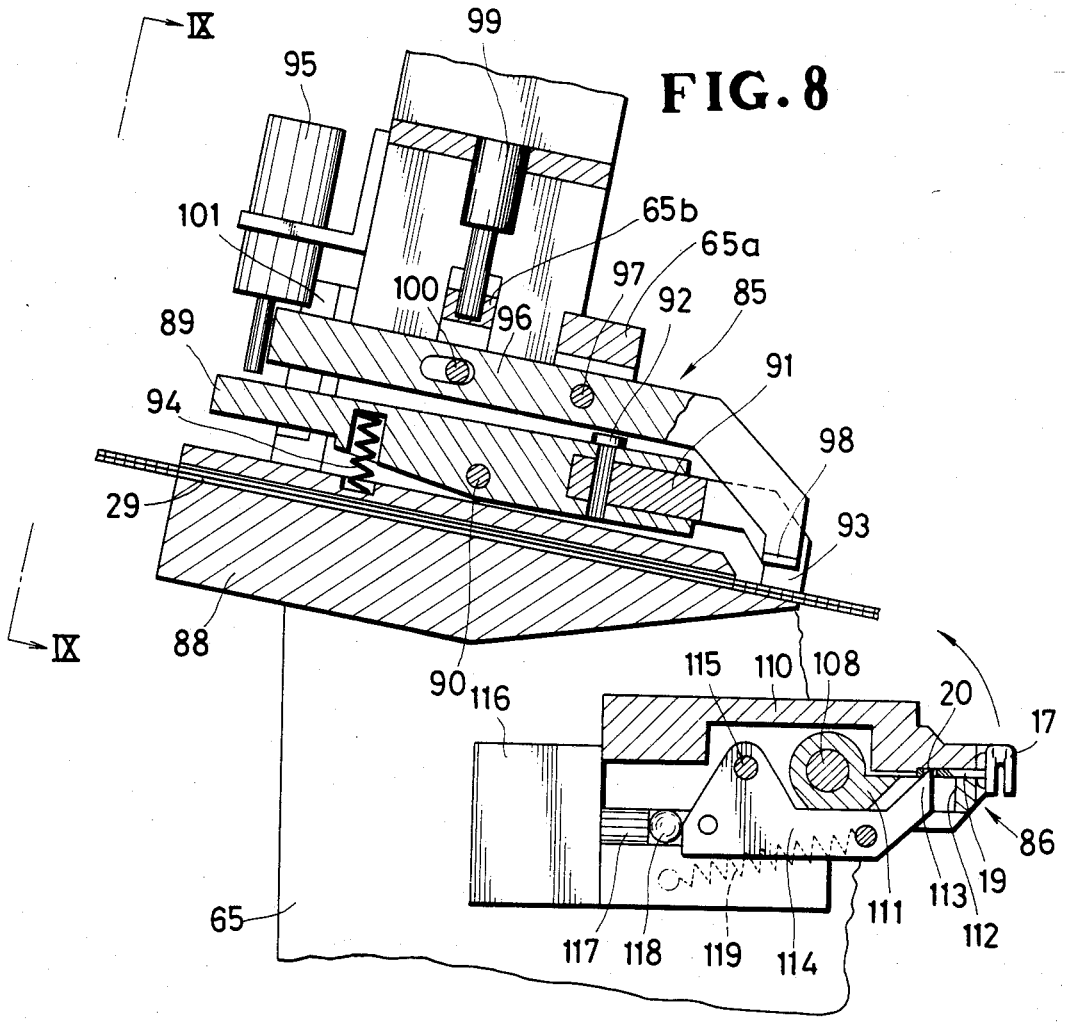
FIG. 8 is a vertical cross-sectional view of a chain splitter and a slider supply unit.

The slider supply unit 86 is disposed below the downstream end of the chain splitter 85 and angularly movably supported on a horizontal shaft 108 mounted on a post 109 vertically disposed on the bed 30. As shown in FIG. 8, a slider holder 110 is securely fitted over the shaft 108, and a clip 111 is rotatably mounted on the shaft 108 for holding the pull tab 19 of a slider 17 against the slider holder 110, the clip 111 having a through-hole 112. A lever 114 angularly movably mounted by a pin 115 on the slider holder 110 has a locking prong 113 for engaging in the hole 20 in the pull tab 19 through the hole 112 in the clip 111. The locking prong 113 is forced into the hole 20 in the pull tab 19 by a sixth fluid cylinder 116 having a piston rod 117 acting on the lever 114 through a steel ball 118. The locking prong 113 is normally urged to move in a direction out of the pull tab hole 20 under the resiliency of a tension spring 119 acting between the slider holder 110 and the lever 114.

Figure 11:
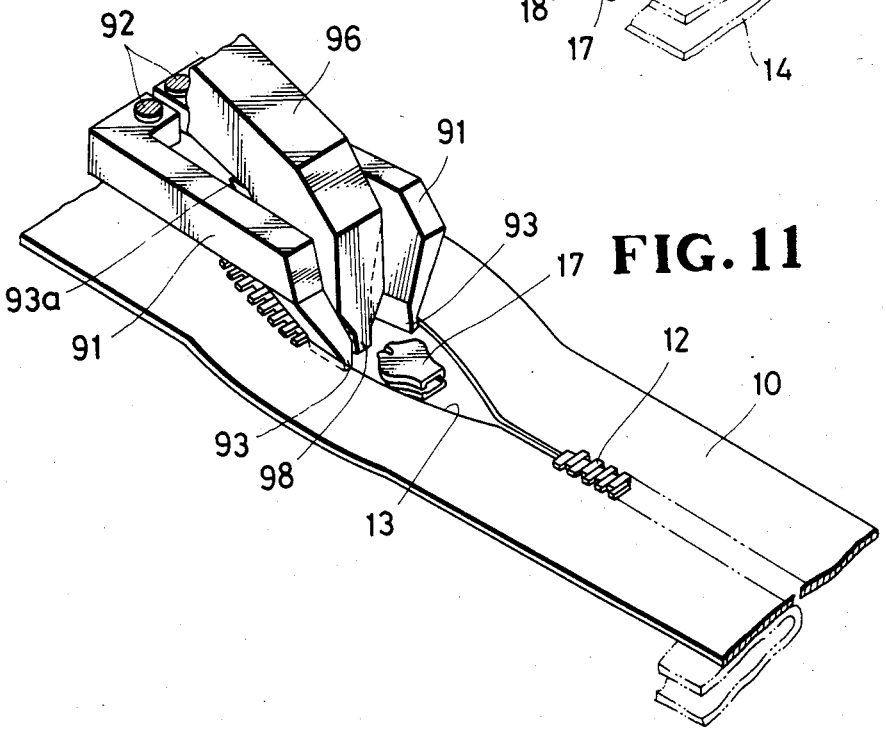
FIG. 11 is a perspective view of the slide fastener chain as it is spread by the chain splitter.
Figure 14:
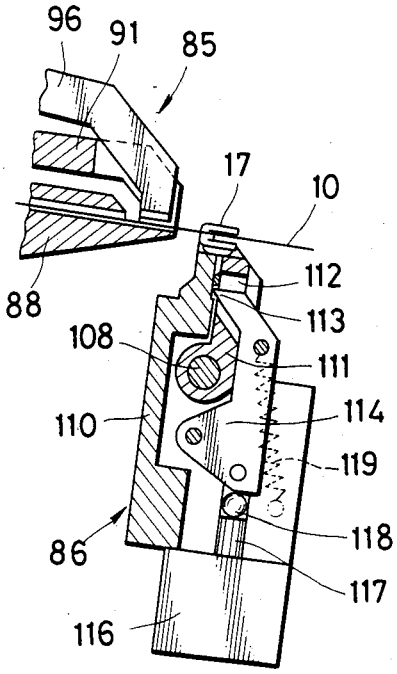
FIG. 14 is a vertical cross-sectional view of the slider supply unit as it places a slider in an element-free space in a slide fastener chain.

Sliders 17 are successively delivered from a chute 82 (FIG. 3) to the slider holder 110. The shaft 108 is moved back and forth through an angle of about 90 degrees to move the slider holder 110 between substantially horizontal and vertical positions, the angular movement of the shaft 108 being effected by a pinion (not shown) fixed to the shaft 108 and meshing with a rack (not shown) actuatable by a fluid cylinder (not shown). The slider holder 110 receives one slider 17 at a time from the chute 82 with the shoulders 18 of the slider 17 directed upwardly as shown in FIG. 10 when the slider holder 110 is in the horizontal position (FIG. 8). When the slider holder 110 is turned into the vertical position (FIG. 14) to position the slider 17 in the element-free space 13 as it is spread by the fingers 93 as illustrated in FIG. 11, the shoulders 18 of the slider 17 are oriented toward the leading end of following intermeshed rows of coupling elements 12, with the pull tab 19 depending downwardly, and the slider 17 is angularly positioned in parallel to the chain 10.

The tape edge inserter 87 is disposed above the feed path 29 between the chain splitter 85 and the feed roller assembly 32, as shown in FIG. 3. The tape edge inserter 87 comprises a substantially horizontal rod 121 secured to a piston rod 129 (FIG. 12) of a seventh fluid cylinder 120 mounted on the mount plate 65. The horizontal rod 121 extends substantially perpendicularly to the feed path 29, and is movable downwardly by the seventh fluid cylinder 120 for depressing engagement with the chain 10 (FIG. 13).

Figure 16:
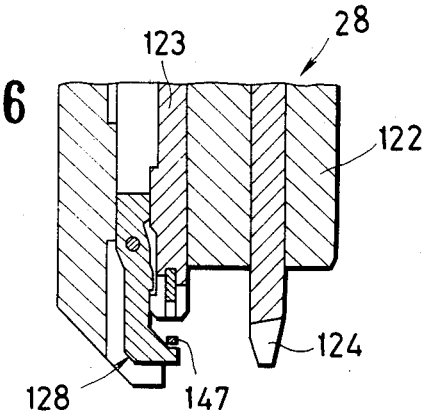
FIG. 16 is a fragmentary vertical cross-sectional view of a bottom stop applicator and a chain cutter.
Figure 17:
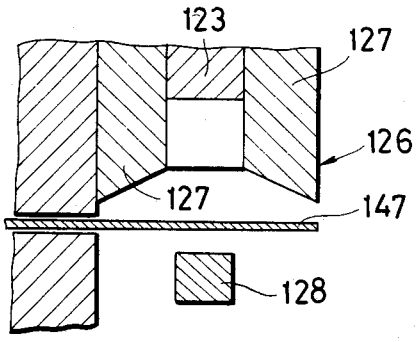
FIG. 17 is an enlarged fragmentary vertical cross-sectional view of the bottom stop applicator before it cuts off a bottom stop blank wire.
Figure 18:
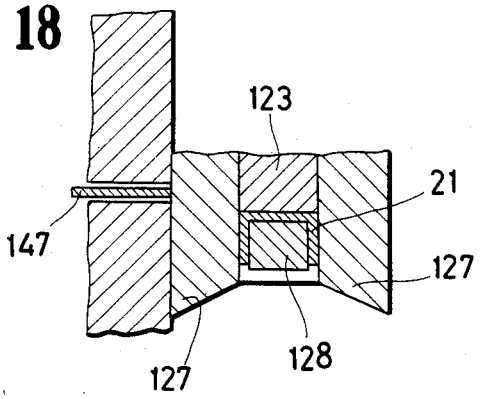
FIG. 18 is an enlarged fragmentary vertical cross-sectional view of the bottom stop applicator after it has produced a bottom stop from the bottom stop blank wire.

The bottom stop applicator and chain cutter 28 generally comprises, as shown in FIG. 16, a casing 122 mounted on the mount plate 65, and a punch 123 and a cutter 124 vertically movably disposed in the casing 122 and drivable by an eighth fluid cylinder 125 mounted on the mount plate 65. The punch 123 is positioned in another cutter 126 having cutter blades 127 one of which cuts off, upon depression, a bottom stop blank wire 147 supplied horizontally below the punch 123, as shown in FIG. 17. A blank wire length as severed by the cutter blade 127 is formed into a bottom stop 21 by coaction of the descending punch 123 and a wire bender 128 located therebelow, as shown in FIG. 18. The formed bottom stop 21 is then applied to the leading end of the intermeshed rows of coupling elements 12 by the punch 123 which is continuously depressed, while at the same time the chain 10 is transversely cut off across the element-free space 13 adjacent to the leading end of the intermeshed rows of coupling elements 12.

As shown in FIGS. 3 and 4, a vertical stop bar 130 is angularly movably mounted on an end of a lever 131 pivotably mounted by a pin 132 on the mount plate 65. The stop bar 130 has an upper end normally slidably held against a lower surface of the intermeshed rows of coupling elements 12, and a lower end normally engaging a sensor 133. When an element-free space 13 in the chain 10 reaches the upper end of the stop bar 130, the stop bar 130 is moved upwardly under the bias of a spring 144 acting on the lever 131 for projection into the space 13. The upper end of the stop bar 130 is slightly displaced downstream due to the movement of the chain 10, whereupon the lower end of the stop bar 130 disengages from the sensor 133 which issues a signal to de-energize the motor 67. A ninth fluid cylinder 145 is mounted on the mount plate 65 for acting on the lever 131 to lower the stop bar 130 out of the space 13 when the chain 10 is to be fed along again. The lever 131 has an adjustment screw 146 for adjusting the interval which the stop bar 130 is vertically movable.

Operation of the apparatus thus constructed is as follows: The slide fastener chain 10 with the fly 14 stitched thereto is fed along the feed path 29 first into the fly folder 26 in which the fly 14 is folded on itself by the guide plate 47 while the chain 10 is guided by the guide roller assembly 31, as shown in FIG. 5. The chain 10 is driven through the chain splitter 85 by the feed roller assembly 32 with the fingers 93, 93 contacting the upper surface of the intermeshed rows of coupling elements 12, as shown in FIG. 10. At this time, a slider 17 is mounted on the slider holder 110 angularly positioned as shown in FIG. 8, with the open shoulders 18 opening upwardly. The slider 17 is securely retained in place by the locking prong 113 engaging in the pull tab hole 20. As an element-free space 13 reaches the fingers 93, 93, the fingers 93, 93 project downwardly into the space 13. Upon continued travel of the chain 10, the fingers 93, 93 abut against the leading end of a successive length of coupling elements 12, whereupon the clutch disk 73 is disengaged from the clutch plate 71 to stop movement of the chain 10 and the brake mechanism 39 is actuated in response to a signal from the sensor 107, to keep the chain 10 under tension. Then the fifth cylinder 99 is actuated to retract its piston rod, whereupon the wedge 98 is lowered to spread the fingers 93, 93 apart to open the space 13 and split open the leading end of the rows of coupling elements 12, as shown in FIG. 11. The slider supply unit 86 is turned counterclockwise from the position shown in FIG. 8 to that shown in FIG. 14 to position the slider 17 in the space 13. Retracting movement of the piston rod of the cylinder 99 causes the rear end of the lever 96 to engage the cam surface 105 and to urge the detector plate 101 to rotate against the bias of the spring 103 until the detector rod 106 engages the sensor 107, as shown in FIG. 9. Then the fourth cylinder 95 is actuated to extend its piston rod, whereupon the arm 89 is rotated countercloskwise (FIG. 8) about the pin 90 against the bias of the spring 94 to thereby move the fingers 93, 93 upwardly away from the element-free space 13. The confronting inner edges of the stringer tapes 11, 11 are now inserted into the slider 17 through side slots therein. To enable the tape edges to be reliably inserted into the slider 17, the rod 121 of the tape edge inserter 87 is lowered to depress the chain 10 so that the tape edges which may have engaged an upper slider surface will enter the slider 17, as illustrated in FIGS. 12 and 13. During this time, the upper feed roller 48 is lowered to sandwich the chain 10 between the upper and lower feed rollers 48, 49, and the upper and lower discharge rollers 61, 62 sandwich the chain 10 therebetween.

The rack 80 (FIG. 7) is then actuated by the third fluid cylinder 81 to turn the lower discharge roller 62 through a certain angular interval against the braking force effected by the brake mechanism 39. The lower feed roller 49 is also turned by the chain 55 in synchronism with the lower discharge roller 62. The chain 10 is advanced slightly to cause the rows of coupling elements 12 to enter the slider 17 through the open shoulders 18, 18, respectively, whereupon the slider 17 is placed on the rows of coupling elements 12.

Figure 15:
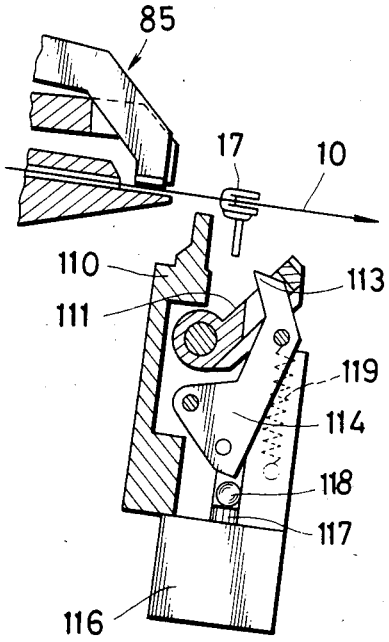
FIG. 15 is a view similar to FIG. 14, illustrating the slider released from a slider holder.

Then, the brake mechanism 39 is inactivated, and the sixth fluid actuator 116 is inactivated to move the locking prong 113 away from the slider holder 110 for thereby releasing the slider 17, as shown in FIG. 15. The upper feed roller 48 is raised by the first fluid cylinder 23, and the clutch disk 73 is engaged with the clutch plate 71 with the result that the lower discharge roller 62 is driven by the motor 67 through the drive mechanism 68 (FIG. 7) to feed the chain 10 with the slider 17 mounted thereon. When the leading end of the rows of coupling elements 12 is engaged by the stop bar 130, the lower discharge roller 62 is stopped. Then, a bottom stop is applied and the chain 10 is cut off by the bottom stop applicator and chain cutter 28 in response to actuation of the eighth fluid cylinder 125. The upper feed and discharge rollers 48, 61 are now lowered. A severed slide fastener is then discharged by the discharge roller assembly 33, and the chain 10 is also fed along by the feed roller assembly 32.

During operation of the apparatus, the feed roller assembly 32 engages and drives the rows of coupling elements 12 so that the chain 10 can be fed along reliably regardless of the fly 14 sewn to one of the tapes 11. Since the chain 10 is kept under tension by the brake mechanism 39 when the slider 17 is to be mounted, the tape edges as they are kept taut are depressed by the rod 121 and are reliably brought into the slider 17.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for automatically manufacturing a succession of slide fasteners with flies from a continuous slide fastener chain having a pair of intermeshed rows of coupling elements with element-free spaces therein and stringer tapes supporting the rows of coupling elements, respectively, with the flies sewn to one of the tapes, comprising:

(a) means defining a feed path along which the chain can be fed;

(b) first means in said feed path for folding one of the flies on itself at a time;

(c) second means in said feed path for mounting one of the sliders at a time on the rows of coupling elements, said second means comprising:

(1) a chain splitter for spreading the element-free space and splitting a leading end of the rows of coupling elements, and (2) a slider supply unit angularly movable between a first position in which it receives a slider and a second position for placing the slider in the spread element-free space;

(d) said chain splitter comprising:

(1) an angularly movable arm, (2) a pair of laterally spreadable levers having a pair of fingers, respectively, (3) a spring acting on said arm for normally urging said fingers to contact said rows of coupling elements, and (4) a pivotable lever having a wedge movable between said fingers to spread the fingers when said fingers project into the element-free space;

(e) a feed roller assembly for feeding the chain along said feed path in selective engagement with the intermeshed rows of coupling elements;

(f) third means in said feed path for applying a bottom stop to the rows of coupling elements;

(g) fourth means in said feed path for cutting off the chain across one of the element-free spaces to produce a slide fastener with a fly; and (h) a discharge roller assembly actuatable in synchronism with said feed roller assembly for discharging the assembled slide fastener with the fly.

2. An apparatus for automatically manfuacturing a succession of slide fasteners with flies from a continuous slide fastener chain having a pair of intermeshed rows of coupling elements with element-free spaces therein and stringer tapes supporting the rows of coupling elements, respectively, with the flies sewn to one of the tapes, comprising:

(a) means defining a feed path along which the chain can be fed;

(b) first means in said feed path for folding one of the flies on itself at a time;

(c) second means in said feed path for mounting one of the sliders at a time on the rows of coupling elements, said second means comprising:

(1) a chain splitter for spreading the element-free space and splitting a leading end of the rows of coupling elements, (2) a slider supply unit angularly movable between a first position in which it receives a slider and a second position for placing the slider in the spread element-free space, and (3) a tape edge inserter disposed adjacent to said chain splitter and said slider supply unit for depressing said stringer tapes to insert confronting edges thereof into said slider as placed in said element-free space by said slider supply unit, said tape edge inserter comprising a fluid cylinder and a rod extending across said feed path and actuatable by said fluid cylinder for engaging and depressing said stringer tapes;

(d) a feed roller assembly for feeding the chain along said feed path in selective engagment with the intermeshed rows of coupling elements;

(e) third means in said feed path for applying a bottom stop to the rows of coupling elements;

(f) fourth means in said feed path for cutting off the chain accross one of the element-free spaces to produce a slide fastener with a fly; and (g) a discharge roller assembly actuatable in synchronism with said feed roller assembly for discharging the assembled slide fastener with the fly.

3. An apparatus for automatically manufacturing a succession of slide fasteners with flies from a continuous slide fastener chain having a pair of intermeshed rows of coupling element with element-free spaces therein and stringer tapes supporting the rows of coupling element, respectively, with the flies sewn to one of the tapes, comprising:

(a) means defining a feed path along which the chain can be fed;

(b) first means in said feed path for folding one of the flies on itself at a time;

(c) second means in said feed path for mounting one of the sliders at a time on the rows of coupling elements;

(d) a feed roller assembly for feeding the chain along said feed path in selective engagement with the intermeshed rows of coupling elements; said feed roller assembly comprising:

(1) a pair of feed rollers for sandwiching said rows of coupling element therebetween, and (2) a fluid cylinder selectively actuatable for moving one of said feed rollers toward and away from the other feed roller;

(d) third means in said feed path for applying a bottom stop to the rows of coupling elements;

(e) fourth means in said feed path for cutting off the chain accross one of the element-free spaces to produce a slide fastener with a fly; and (f) a discharge roller assembly actuatable in synchronism with said feed roller assembly for discharging the produced slide fastener with the fly.

4. An apparatus according to claim 1, said first means including a guide roller assembly for guiding the rows of coupling elements to travel along said feed path, a guide plate for folding over said fly on itself, and a brake mechanism for braking said guide roller assembly to keep said chain under tension across said second means in response to projection of said fingers into said element-free space.

5. An apparatus according to claim 4, said guide roller assembly comprising a pair of idler rollers for sandwiching said rows of coupling elements, said brake mechanism being operatively coupled with one of said idler rollers.

6. An apparatus according to claim 4, said chain splitter including a detector plate engaging said arm and movable in response to movement of said arm caused by projection of said fingers into said element-free space, and a sensor energizable in response to movement of said detector plate for issuing a signal to actuate said brake mechanism.

7. An apparatus according to claim 1, said second means including a tape edge inserter disposed adjacent to said chain splitter and said slider supply unit for depressing said stringer tapes to insert confronting edges thereof into said slider as placed in said element-free space by said slider supply unit.

8. An apparatus according to claim 1, said discharge roller assembly comprising a motor, a first driven discharge roller rotatable by said motor, and a pair of second idling discharge rollers coacting with said first driven discharge roller for discharging the assembled slide fastener, further including means for turning said driven discharge roller for an angular interval to move said leading end of the rows of coupling elements into and through said slider as positioned in said element-free space while said motor is being de-energized.

9. An apparatus according to claim 8, said turning means including a fluid cylinder, a rack movable by said fluid cylinder, and a pinion mounted on a shaft of said driven discharge roller and meshing with said rack.

10. An apparatus according to claim 3, said feed rollers having roughened peripheral surfaces, respectively, confronting each other for engaging said rows of coupling elements.

11. An apparatus according to claim 3, said discharge roller assembly comprising a pair of first discharge rollers and a second discharge roller coacting with said first discharge rollers for sandwiching said chain therebetween, a fluid cylinder selectively actuatable for moving one of said pair of first discharge rollers and said second discharge roller toward and away from said other feed roller, a motor for rotating said other discharge roller, and a mechanism by which said other feed roller and said other discharge roller are operatively coupled for synchronous rotation.

12. An apparatus according to claim 11, said mechanism including a first sprocket mounted on a shaft of said other feed roller, a second sprocket mounted on a shaft of said other discharge roller, and an endless chain trained around said first and second sprockets.

* * * * *